US008668795B2

(12) United States Patent
Tippins et al.

(10) Patent No.: US 8,668,795 B2
(45) Date of Patent: Mar. 11, 2014

(54) METHOD OF PRE-PRIMING A MEMBRANE

(75) Inventors: William D. Tippins, Carmel, IN (US); Norman G. Ninow, Noblesville, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 342 days.

(21) Appl. No.: 13/030,174

(22) Filed: Feb. 18, 2011

(65) Prior Publication Data

US 2011/0198023 A1 Aug. 18, 2011

Related U.S. Application Data

(60) Provisional application No. 61/305,657, filed on Feb. 18, 2010.

(51) Int. Cl.
*E04D 5/12* (2006.01)
*E04D 5/06* (2006.01)

(52) U.S. Cl.
USPC ..... 156/71; 156/271; 156/289; 427/210

(58) Field of Classification Search
None
See application file for complete search history.

(56) References Cited

U.S. PATENT DOCUMENTS

| | | | | |
|---|---|---|---|---|
| 1,831,764 | A * | 11/1931 | Evans | 428/104 |
| 2,130,605 | A * | 9/1938 | Staude | 427/202 |
| 5,466,211 | A | 11/1995 | Komarek et al. | |
| 5,595,618 | A | 1/1997 | Fries et al. | |
| 6,924,015 | B2 | 8/2005 | Zanchetta et al. | |
| 7,175,732 | B2 | 2/2007 | Robison et al. | |

* cited by examiner

*Primary Examiner* — Barbara J Musser
(74) *Attorney, Agent, or Firm* — Jason A. Houser; Arthur M. Reginelli

(57) ABSTRACT

A method of pre-priming a membrane includes folding the membrane along a longitudinal axis to create a folded membrane. The folded membrane includes a lower layer, an upper layer, and an exposed portion of the lower layer that is uncovered by the upper layer. A primer is applied over the exposed portion and a portion of the upper layer adjacent thereto simultaneously.

26 Claims, 4 Drawing Sheets

METHOD OF PRE-PRIMING A MEMBRANE

PRIORITY STATEMENT

This application claims priority from U.S. provisional patent application Ser. No. 61/305,657 filed on Feb. 18, 2010, which is incorporated herein by reference in its entirety.

FIELD OF THE INVENTION

One or more embodiments of the present invention relate to a method of pre-priming and pre-taping a membrane. More particularly, one or more embodiments of the present invention relate to a method of pre-priming and pre-taping an EPDM membrane by folding the membrane to apply a primer to opposing edge portions.

BACKGROUND OF THE INVENTION

The construction industry commonly uses single ply membranes to provide a waterproof barrier on flat or low-slope roofs. It is prohibitively expensive and difficult to produce and transport a single membrane that is sized to cover an entire roof surface. Thus, a plurality of individual membranes are provided and oriented in an overlapping arrangement. The overlapping portions, or splices, of these individual membranes must be secured together to ensure that the plurality of membranes form a single waterproof surface.

One attachment approach is to secure the adjoining membranes together using an adhesive. In certain embodiments, the adhesive is provided in the form of an adhesive tape. These tapes are positioned between adjacent membrane surfaces and when such surfaces are brought together, the membranes are thereafter secured together. In order to ensure that these tapes effectively bond the adjoining membranes, the areas where tape application occurs should be prepared using a primer. The primer application removes dirt and other debris that may inhibit bonding, as well the anti-sticking agent typically applied to the membrane prior to rolling. Further, the primer leaves a tacky or sticky surface upon which the adhesive tape is applied. This preparation process enhances the adhesion of the tape and consequently helps prevent leaking and/or separation.

Currently, primers are often applied to the membranes while in the field, just before the tape adhesive is applied to the membrane. The tape adhesive is packaged on release liners, which may be paper or plastic based material possessing engineered release characteristics to prevent unwanted adhesion and allow proper unrolling and placement of tape on the primed membrane. After the tape is applied to the primed membrane, the release liner is removed to expose the top side of the tape adhesive. The overlapping primed portion of the adjoining membrane is then mated to the tape adhesive to affix the two membranes together and create a watertight barrier at the lap areas between adjacent membrane panels.

Field priming of the membrane panels is performed by roofing mechanics. During application in the field, roof mechanics may be exposed to the primer chemicals and solvents by direct physical contact during the dispensing and application of the primer and indirectly to the primer's solvent fumes and volatile organic chemicals during the flash-off period.

Field priming of the membrane panels is also subject to improper application. For example, roof mechanics may not apply enough primer or apply it unevenly. They may apply tape before the flash-off period is complete, leading to a degradation of the resulting tape-adhesive bond. The mechanic may also apply the tape too long after primer application allowing dirt and moisture to collect on the primed surfaces. In each of the above instances, the integrity of the field seams may be jeopardized.

Pre-primed and pre-taped membranes have been previously contemplated. However, difficulties have arisen in the factory application of primers and adhesive tapes. One significant difficulty has arisen in developing efficient and effective methods of applying the primers and/or tapes to membranes in the factory. In order to prepare the membrane for installation on a roofing site it is necessary to pre-prime opposing edges of the membrane so that lap seams may be readily formed. The process for applying primer to both edges is time consuming, and if performed manually, labor intensive.

Therefore, there is a need for an improved method of pre-applying primer and/or adhesive tape to a membrane to improve the efficiency of the process.

SUMMARY OF THE INVENTION

One or more embodiments of the present invention provide a method of pre-priming a membrane including folding a membrane having opposing longitudinal edges along a longitudinal axis, the folded membrane having a lower layer and an upper layer, wherein the longitudinal edges of the lower and upper layers are spaced from one another to provide an exposed portion of the lower layer; applying a primer over the exposed portion of the lower layer and over an edge portion of the upper layer adjacent to the longitudinal edge; and allowing the primer to flash-off to create a first primed area on the exposed portion of the lower layer and a second primed area on the edge portion of the upper layer.

One or more embodiments of the present invention also provides a method of pre-priming a membrane including folding a first longitudinal edge of a membrane toward a center of the membrane along a first longitudinal axis; folding a second longitudinal edge of the membrane toward the center of the membrane along a second longitudinal axis to create a folded membrane, wherein the first and second longitudinal edges are each spaced from a center of the membrane to provide an exposed portion of a lower layer of the folded membrane; and applying a primer over the exposed portion of the lower layer, a first edge portion adjacent the first longitudinal edge of the membrane and a second edge portion adjacent the second longitudinal edge of the membrane.

One or more embodiments of the present invention also provides a method of pre-priming a membrane including folding a membrane having opposing longitudinal edges along a longitudinal axis to create a folded membrane, wherein the folded membrane includes a lower layer and an upper layer, and wherein a portion of the lower layer is uncovered by the upper layer; and applying a primer over at least a part of the uncovered portion of the lower layer and at least a part of the upper layer simultaneously.

DETAILED DESCRIPTION OF THE ILLUSTRATIVE EMBODIMENTS

Embodiments of the present invention produce a membrane having pre-primed areas on opposing planar surfaces adjacent to opposing longitudinal edges. Thus, a first pre-primed area is provided along a first longitudinal edge on a top planar surface of the membrane, and a second pre-primed area is provided along a second longitudinal edge on a bottom planar surface of the membrane. The method involves first folding the membrane along a longitudinal axis to create a folded membrane. The folded membrane includes a top layer and a bottom layer, with the top planar surface of the top layer being in contact with the top planar surface of the bottom layer. The folded membrane also includes an exposed portion of the bottom layer that is not covered by the top layer of the folded membrane.

The method next includes the step of applying a primer to the exposed portion of the lower layer and to an edge portion of the top layer, and allowing the solvents in the primer to evaporate. In this way a pre-primed membrane is produced with pre-primed areas along the longitudinal edges thereof, the pre-primed areas being on opposing planar surface of the membrane. Optionally, an adhesive tape may be applied over one of the pre-primed areas to create a membrane having one pre-primed area along one longitudinal edge, and a pre-taped area along the opposing longitudinal edge.

Figure 1:
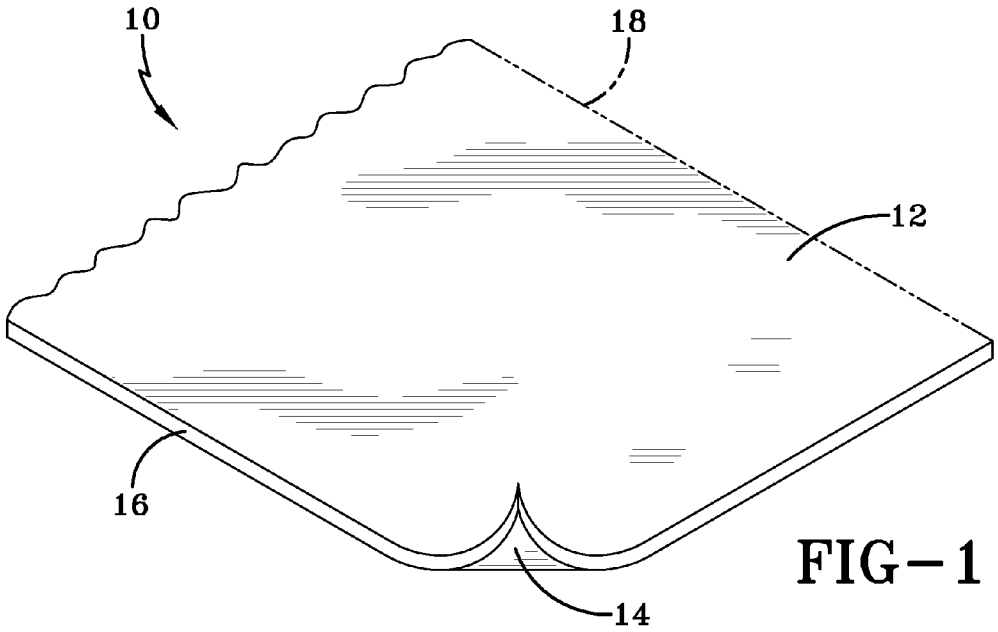
FIG. 1 is a fragmentary perspective view of a roofing membrane according to the concepts of the present invention.

Referring now to FIG. 1, a roofing membrane as contemplated for use in the method of the present invention is shown, and is generally indicated by the numeral 10. Practice of the present invention is not necessarily limited by the selection of a particular membrane. As is known in the art, numerous roofing membranes have been proposed in the art and several are used commercially, including thermoset and thermoplastic roofing membranes. Commercially available thermoplastic roofing membranes may include polyvinyl chloride, or polyolefin copolymers. For example, thermoplastic polyolefin (TPO) membranes are available under the tradenames UltraPly™, and ReflexEON™ (Firestone Building Products). Commercially available thermoset roofing membranes may include elastomeric copolymers such as ethylene propylene diene copolymer (EPDM) rubber and functionalized olefins such as chlorosulfonated polyethylene (CSPE). For example, EPDM membranes are available under the tradename RubberGard™, RubberGard Platinum™, RubberGard EcoWhite™, and RubberGard MAX™ (Firestone Building Products).

In particular embodiments, EPDM membranes are employed. As is known in the art, EPDM membrane panels include vulcanized or cured rubber compositions. These compositions may include, in addition to the rubber that is ultimately vulcanized, fillers, processing oils, and other desired ingredients such as plasticizers, antidegredants, adhesive-enhancing promoters, etc., as well as vulcanizing agents such as sulfur or sulfur-donating compounds.

In one or more embodiments, the EPDM roofing panels have a thickness in accordance with ASTM D-4637-04. In one or more embodiments, the EPDM roofing panels have a thickness of at least 45 mil±10%, in other embodiments at least 60 mil±10%, and in other embodiments at least 90 mil±10%. In these or other embodiments, the EPDM roofing panels may have a thickness of less than 110 mil±10%, in other embodiments less than 80 mil±10%, and in other embodiments less than 65 mil±10%.

Membrane 10 includes a top planar surface 12 and a spaced bottom planar surface 14. Membrane 10 may be a single-ply membrane and may be in the form of an elongated sheet, and includes a first longitudinal edge 16 and a second longitudinal edge 18 on opposing longitudinal sides of the membrane. In one or more embodiments, membrane 10 may be from about 25 to about 400 feet (8-122 m) in the longitudinal direction. Longitudinal, as used herein, refers to the direction and/or dimension generally parallel to longitudinal edges 16 and 18. In these or other embodiments, membrane 10 may be from about 5 to about 50 feet (1.5-15 m) in the transverse direction. It will be understood by those skilled in the art that the transverse direction and/or dimension is generally orthogonal to longitudinal edges 16 and 18.

Figure 2:
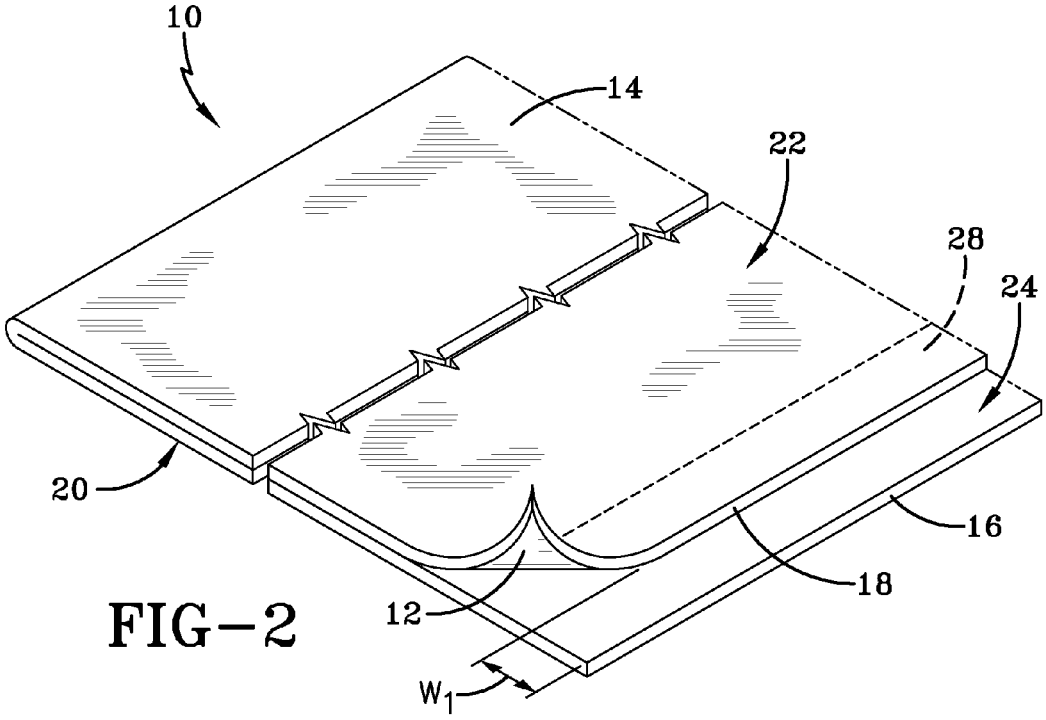
FIG. 2 is fragmentary perspective view of a folded roofing membrane according to the concepts of the present invention.

Referring now to FIG. 2, membrane 10 may be folded approximately in half along a longitudinal axis to create a lower layer 20 and an upper layer 22 of a folded membrane. Lower layer 20 and upper layer 22 are each formed from a portion of the membrane 10, and may also be referred to as lower portion 20 and upper portion 22 of membrane 10. When membrane 10 is folded, top surface 12 of upper layer 22 rests against top surface 12 of lower layer 20 and bottom surface 14 of upper layer 22 is exposed. Membrane 10 is folded in such a way that an exposed portion 24 of lower layer 20 is left uncovered by upper layer 22. Exposed portion 24 is a portion of the top planar surface 12 of lower layer 20 adjacent first longitudinal edge 16. In one or more embodiments, exposed portion 24 may have a width $W_1$ of between approximately 1 and 12 inches (25-305 mm). In other embodiments, exposed portion 24 may have a width $W_1$ of between approximately 3 and 8 inches (76-203 mm). In still other embodiments, exposed portion 24 may have a width $W_1$ of less than approximately 10 inches (254 mm). In a preferred embodiment, exposed portion 24 extends substantially the entire longitudinal length of the folded membrane 10.

Figure 3:
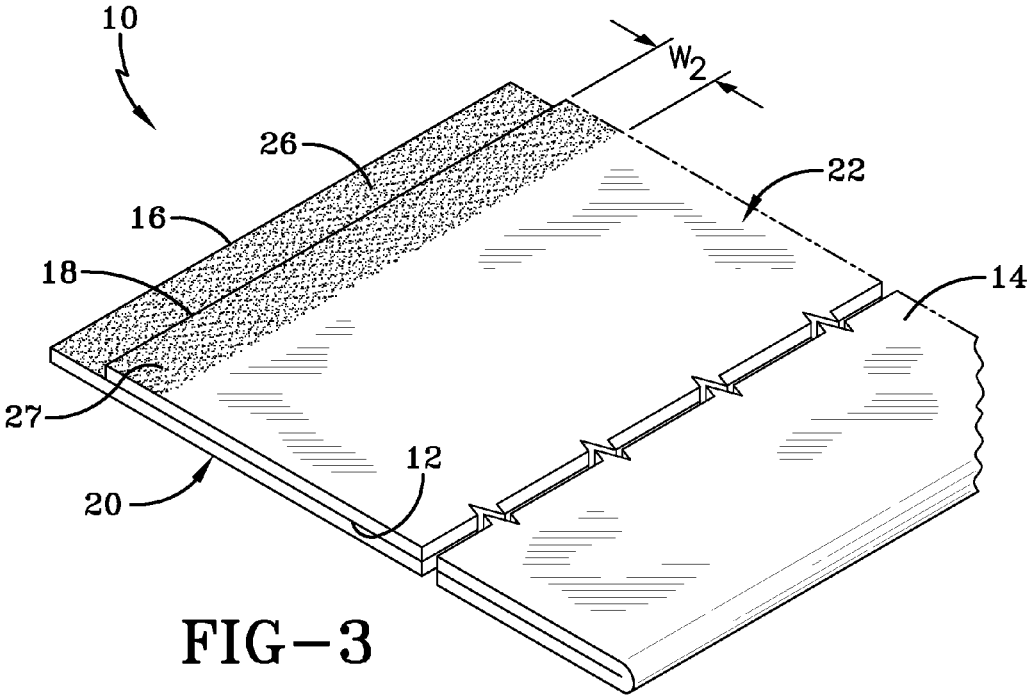
FIG. 3 is a fragmentary perspective view of a roofing membrane having primed edges according to the concepts of the present invention.

Following the step of folding, primer layers 26 and 27 are formed by applying a primer over exposed portion 24 and an edge portion 28 of upper layer 22, respectively (FIG. 3). Edge portion 28 is a portion of the bottom planar surface 14 on top layer 22 adjacent to second longitudinal edge 18, as indicated by the dashed line in FIG. 2. In one or more embodiments, primer layer 27 on edge portion 28 may have a width $W_2$ of between approximately 3 and 12 inches (76-305 mm). In other embodiments primer layer 27 on edge portion 28 may have a width $W_2$ of between approximately 4 and 8 inches (102-203 mm). In still other embodiments, primer layer 27 on edge portion 28 may have a width $W_2$ of less than approximately 10 inches (254 mm).

Primer layer 26 on exposed portion 24 will have a width approximately equal to the width of exposed portion 24. In one or more embodiments, primer layers 26 and 27 extend substantially the entire length of both first longitudinal edge 16 and second longitudinal edge 18. In these or other embodiments, primer layers 26 and 27 will have a width $W_1$ and $W_2$ that is generally constant along the longitudinal length of membrane 10. In certain embodiments, the width $W_1$ and $W_2$ of primer layers 26 and 27 may vary slightly along the longitudinal length of membrane 10.

The primer that forms primer layers 26 and 27 may be applied to membrane 10 by any method or mechanism known to those skilled in the art. For example, in certain embodiments the primer may be applied using a scrubber pad. In other embodiments, the primer may be applied using a spraying device. In these or other embodiments, the primer may be applied using automated machinery or may be applied by manual labor.

Primer layers 26 and 27 may be formed from a solvent based primer. In one or more embodiments, polymeric material may be suspended or dissolved in the solvent. In one or more embodiments, the primer may be less than 20% solids. In other embodiments, the primer may be less than 16% solids. In still other embodiments, the primer may be less than 10% solids. In certain embodiments, the polymeric material may include polymer tacifying resins. Examples of suitable solvent based primers may include Firestone QuickPrime Plus, Firestone QuickPrime Plus LVOC, ADCO HSSP-1 and Ashland PLIOSEAL™ 9705.

As is known in the art, the solvents and carrier components present in the primer will, upon exposure to air, vaporize. After the primer has been applied to create primer layers 26 and 27, the volatile portion of the primer vaporizes, with the solids portion remaining on membrane 10 being thereafter ready to promote adhesion with an adhesive tape, as will be hereinafter described. This vaporization period is also known as the "flash-off period." Thus, it should be appreciated that a sufficient "flash-off period" is provided after application of the primer to ensure that substantially all of the solvents and carrier components have vaporized.

After the "flash-off period," primer layers 26 and 27 are generally tacky and substantially free from dirt, debris, anti-sticking dusting agents and other contaminants that may inhibit adhesion between adjoining membranes. As used herein the term tacky should be interpreted as possessing a minimal degree of tack or adhesive qualities, as would be understood by those skilled in the art. After solvent flash-off, the remaining solids portion of the primer may be described as a polymeric film. In one or more embodiments, the film includes a thickness of greater than 0.001 inches (25 μm). In still other embodiments, the film includes a thickness of less than 0.007 inches (178 μm). In other embodiments, the film includes a thickness of less than 0.005 inches (127 μm). In still other embodiments, the film includes a thickness of less than 0.003 inches (76 μm).

It will be apparent to those skilled in the art that the above described method of pre-priming a membrane produces a membrane 10 having a first pre-primed portion 26 on a top planar surface 12 adjacent to a first longitudinal edge 16 and a second pre-primed portion 27 on a bottom planar surface 14 adjacent to a second longitudinal edge 18. The primer is applied to both pre-primed areas either simultaneously or in immediate succession so that time must be allowed for the solvents in the primer to evaporate only once.

Although primer layers 26 and 27 are tacky, they do not exhibit the same adhesive qualities as the adhesive tape described herein below. For example, a lap seam formed with just two primed surfaces and no tape may be characterized by a peel strength of less than 1.0 pli (1.75 N/cm). A lap seam including primed surfaces and adhesive tape may be characterized by a peel strength of at least 1.8 pli (3.15 N/cm). In other embodiments the peel strength of the taped lap seam may be at least 2 pli (3.5 N/cm). In still other embodiments the peel strength of the taped lap seam may be at least 2.2 pli (3.85 N/cm). As is known in the art, peel strength can be determined by ASTM D413.

Figure 4:
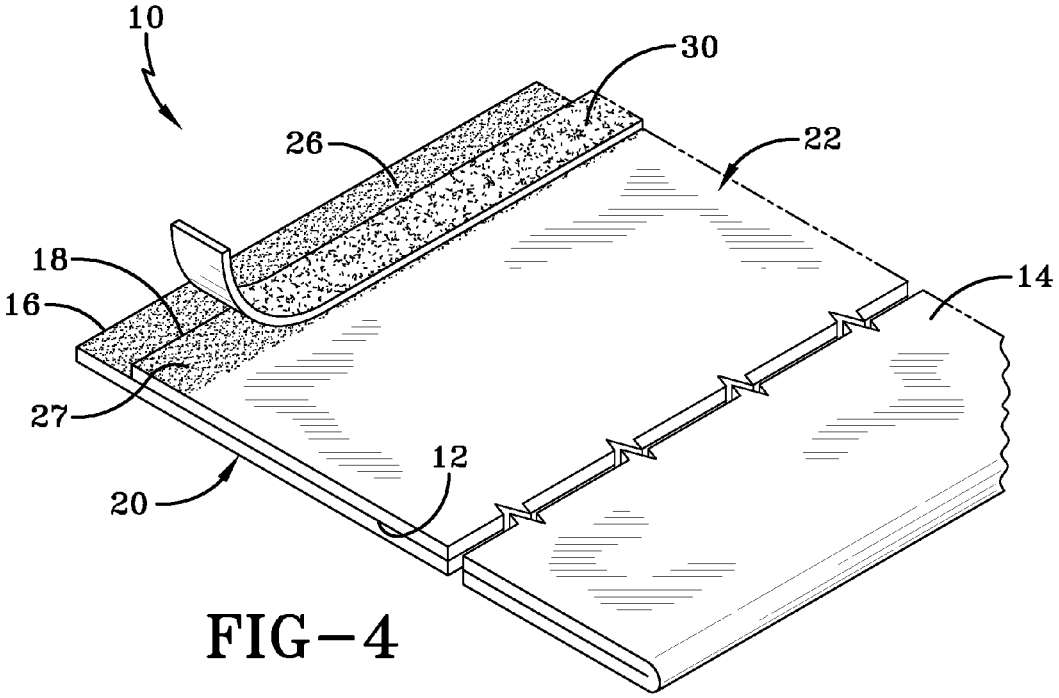
FIG. 4 is a fragmentary perspective view of a membrane having primed edges and an adhesive tape secured thereon.

Referring now to FIG. 4, an adhesive tape 30 may be applied over either primer layer 26 on exposed portion 24 or primer layer 27 on edge portion 28. It is often desirable for the pre-primed membrane to have an adhesive tape secured along one edge, and a pre-primed layer positioned on the opposing edge. In this way, the membranes may be positioned on a roof surface and secured together to create lap seams without requiring significant additional work by roofing mechanics. It is immaterial which primer layer 26 or 27 receives adhesive tape 30 thereon. It is also sometimes desirable to provide a membrane having opposing pre-primed edges, without a pre-applied adhesive tape. Therefore, it is contemplated that adhesive tape 30 may sometimes be applied at the roofing installation site, and not as part of the pre-priming process.

The adhesive tape 30 of the present invention may be a solid adhesive, which may also be referred to as a solid adhesive strip, and may include those that are conventional in the art. In one or more embodiments, adhesive tape 30 may include EPDM and/or butyl rubber. In one or more embodiments, the adhesive tape 30 includes at least 85% solids. In other embodiments, the adhesive tape 30 includes at least 90% solids. In still other embodiments, the adhesive tape 30 includes at least 95% solids. In yet other embodiments, the adhesive tape 30 includes at least 99% solids. In one or more embodiments, the adhesive tape includes a thickness of greater than 0.007 inches (0.178 mm). In other embodiments, the tape includes a thickness greater than 0.01 inches (0.25 mm). In still other embodiments, the adhesive tape includes a thickness greater than 0.1 inches (2.54 mm).

Useful adhesive tapes are disclosed in U.S. Pat. Nos. 6,120,869, 5,888,602, 5,859,114, 5,733,621, 5,612,141, 5,563,217, 5,545,685, 5,504,136, 5,242,727, 4,932,171, 4,849,268, 4,657,958, 4,855,172, 4,588,637, 4,539,344, and 4,426,468, which are incorporated herein by reference. Useful tapes are commercially available including those available under the trade names QuickSeam™ (Firestone), PLIOSEAL™ (Ashland), 510™ (ADCO), 505™ (ADCO).

After flash-off of the primer layers 26 and 27, or alternatively after application of adhesive tape 30, a release liner (not shown) may be positioned over primer layers 26 and 27 and/or adhesive tape 30. It is also contemplated that adhesive tape 30 may be provided with a release liner on a top surface thereof prior to being installed on membrane 10. The release liner acts to prevent contaminants from contacting and collecting on the tacky surfaces. The tackiness of primer layers 26 and 27 and/or adhesive layer 30 holds the release liner thereon.

The release liner may include a thin film or coating to which the primer or adhesive may form a temporary bond. However, this bond can be readily broken by applying minimal tension. The release liner may remain in place until a roof mechanic removes it during rooftop membrane installation. In one or more embodiments release liner 22 may be between approximately 1 and 9 mils (25-229 μm) in thickness, in other embodiments between approximately 1 and 7 mils (25-178 μm) in thickness, in still other embodiments between approximately 2 and 6 (51-152 μm) mils in thickness, and in yet other embodiments between approximately 2 and 4 (51-102 μm) mils in thickness.

In one or more embodiments, the release liner may include a paper or cellulosic structure coated with a polymeric coating. In other embodiments, the release liner may include a homogenous polymeric structure; for example, the release liner may include a polyester or polyolefin film. Suitable materials for the release liner include polypropylene, polyester, high-density polyethylene, medium-density polyethylene, low-density polyethylene, polystyrene or high-impact polystyrene. Such polymeric materials offer a number of advantageous properties, including high moisture resistance, good resistance to temperature fluctuations during processing and storage, and high tear resistance. In one or more embodiments, these release liners may also be provided with anti-static surface coatings. In addition to the above polymeric release liner materials, the release liner may also be made of kraft paper.

It will be appreciated by those skilled in the art that the method of pre-priming and pre-taping a membrane discussed above produces a membrane 10 having a pre-primed portion on one planar surface adjacent to one longitudinal edge, and a pre-taped portion on the opposing planar surface adjacent to the opposing longitudinal edge. One or both of the pre-primed and pre-taped areas may have a release liner positioned thereon.

Referring now to FIGS. 5-8, an alternative to the above described method of manufacturing a pre-primed and pre-taped membrane is discussed. This alternative method is similar in many respects to the above discussed method. However, rather than folding a membrane 110 generally in half, in this embodiment of the invention a first longitudinal edge 116 and a second longitudinal edge 118 of a membrane 110 are folded toward the center of the membrane. Membrane 110 is folded so that first longitudinal edge 116 is spaced from second longitudinal edge 118, thereby leaving an exposed portion 124 of the top planar surface 112 of the membrane.

Folding of membrane 110 creates a lower layer 120, a first upper layer 121 and a second upper layer 122. First upper layer 121 extends from first longitudinal edge 116 to a fold in membrane 110 and second upper layer 122 extends from second longitudinal edge 118 to a fold in membrane 110. Top planar surface 112 of first upper layer 122 rests against the top planar surface 112 of lower layer 120. Likewise, the top planar surface 112 of second upper layer 122 rests on the top planar surface 112 of lower layer 120. As is apparent from the figures, the bottom planar surface 114 of membrane 110 faces upward along first and second upper layers 122 of the folded membrane. First longitudinal edge 116 and second longitudinal edge 118 define the longitudinally extending exposed portion 124 of lower layer 120.

Figure 5:
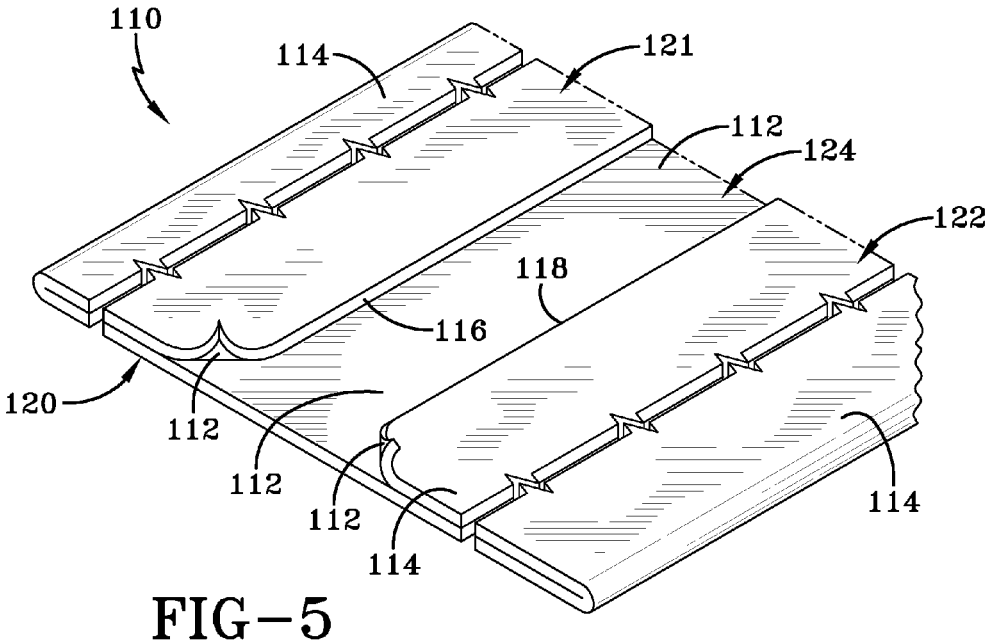
FIG. 5 is a fragmentary perspective view of a membrane with opposing edges folded over toward the center of the membrane according to a second embodiment of the invention.
Figure 6:
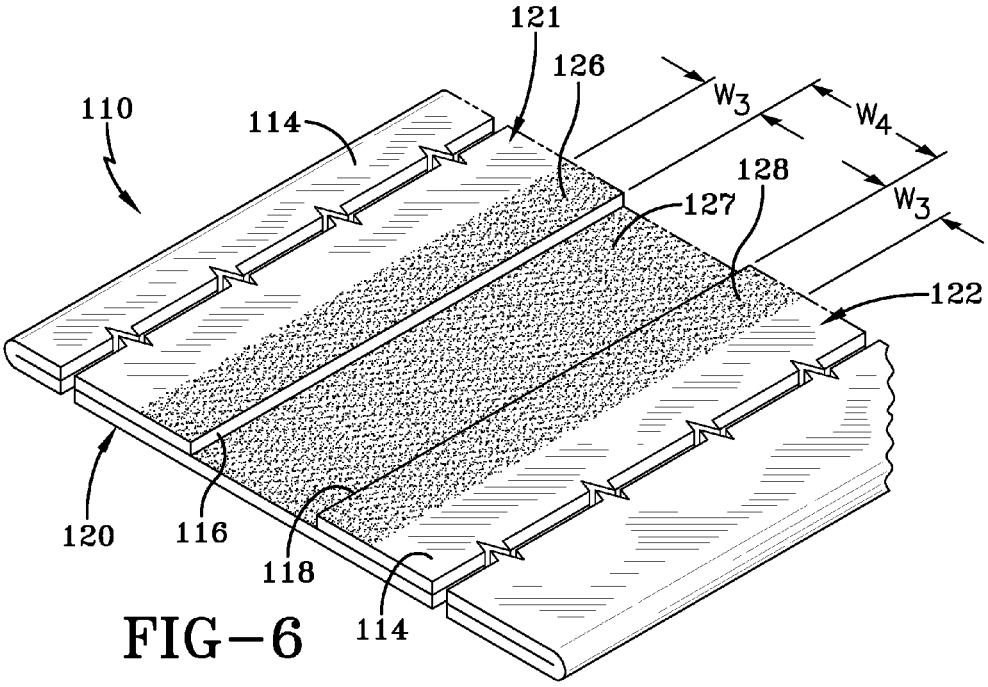
FIG. 6 is a fragmentary perspective view of the folded membrane of FIG. 4 having a primer applied on a portion thereof.

Once membrane 110 has been folded as shown in FIG. 5, a primer is applied over an edge portion of first upper layer 121, exposed portion 124 and an edge portion of second upper layer 122 to create primer layers 126, 127, and 128 thereon, respectively, as shown in FIG. 6. The edge portions of first and second upper layers 121 and 122 are portions of the bottom planar surface 114 of membrane 110 adjacent the first and second longitudinal edges 116 and 118, respectively.

In one or more embodiments, the primer layers 126, and 128 on first upper layer 121 and second upper layer 122 may have a width $W_3$ of between approximately 3 and 12 inches (76-305 mm) and in other embodiments a width $W_3$ of between approximately 4 and 8 inches (102-203 mm) wide. In still other embodiments, the primer layers 126 and 128 may have a width $W_3$ of less than approximately 10 inches (254 mm) wide. In the same or other embodiments, primer layer 127 on exposed portion 124 may have a width $W_4$ of between approximately 4 and 24 inches (102-610 mm), in other embodiments a width $W_4$ of between approximately 6 and 10 inches (152-254 mm), and in still other embodiments a width $W_4$ of less than approximately 15 inches (381 mm). In a preferred embodiment, primer layers 126, 127, and 128 extend substantially the entire longitudinal distance of membrane 110. After the primer has been applied to create primer layers 126, 127, and 128, sufficient time is allowed for the solvents within the primer to vaporize ("flash-off" period).

Figure 7:
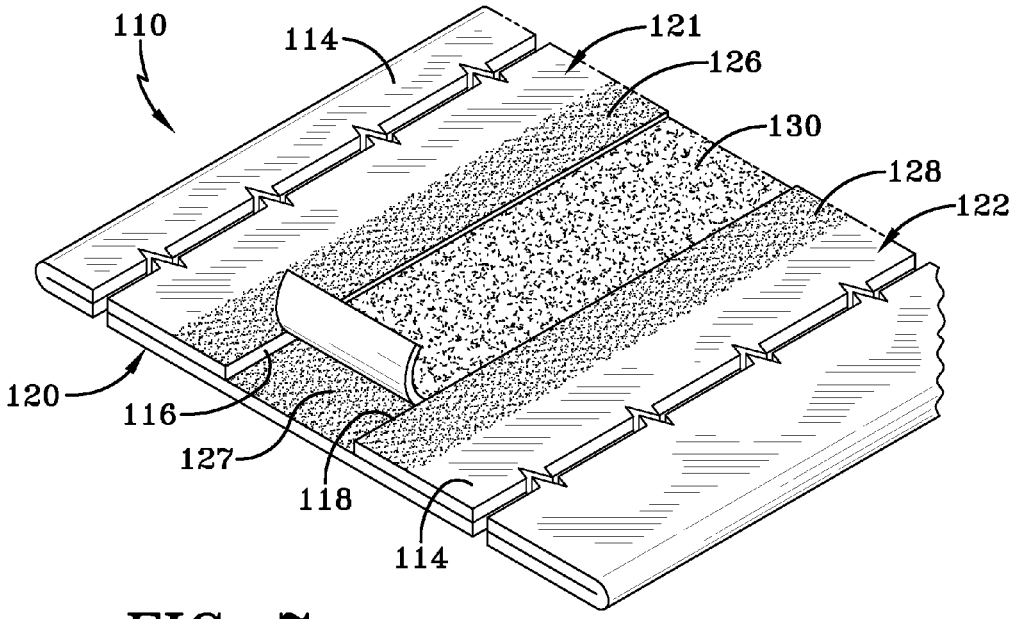
FIG. 7 is a fragmentary perspective view of the folded membrane of FIG. 5 having an adhesive tape applied over a portion of the primed area.
Figure 8:
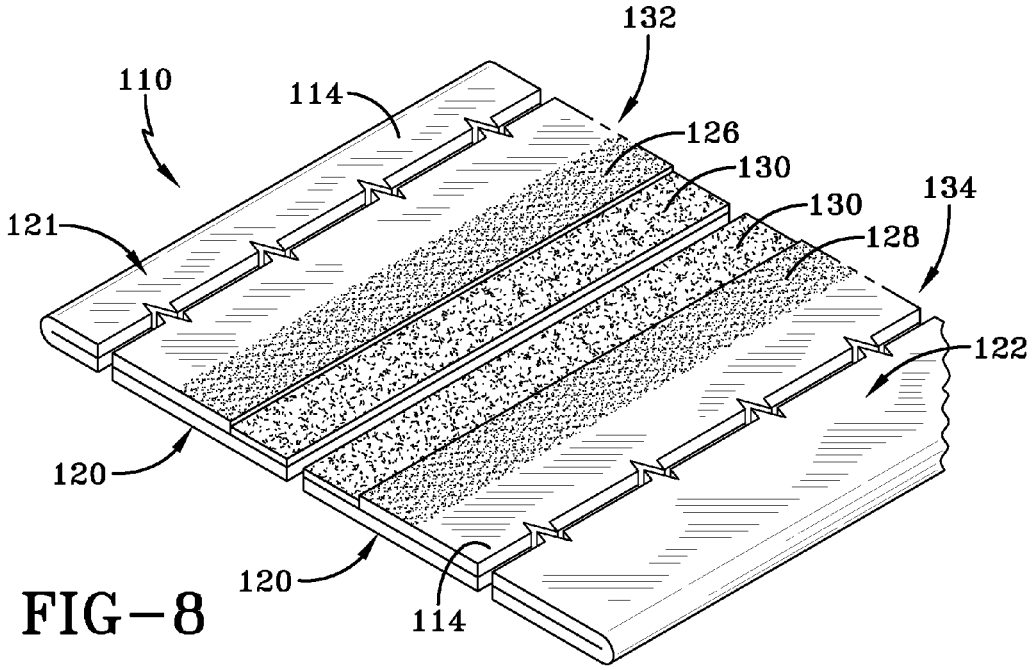
FIG. 8 is a fragmentary perspective view of the membrane of FIG. 6 after it has been cut to create two separate membranes.

In one or more embodiments, an adhesive tape 130 may be applied over primer layer 127 on exposed portion 124, as shown in FIG. 7. Adhesive tape 130 may be between approximately 2 and 16 inches (51-406 mm) wide and, in other embodiments, may be between approximately 6 and 12 inches (152-305 mm) wide. In certain embodiments, adhesive tape 130 substantially covers primer layer 127 on exposed portion 124.

Following flash-off of the primer layers 126, 127 and 128, or placement of adhesive tape 130 over primer layer 127 on exposed portion 124, membrane 110 may be cut down the center of exposed portion 124 to create two separate membranes 132 and 134. Each of these newly created membranes includes a primer layer 126 or 128 on an upper layer 121 or 122, respectively, a primer layer 127 on lower layer 122, and optionally an adhesive tape 130 positioned over primer layer 127.

Various modifications and alterations that do not depart from the scope and spirit of this invention will become apparent to those skilled in the art. This invention is not to be unduly limited to the illustrative embodiments set forth herein.

The invention claimed is:

1. A method of pre-priming a membrane comprising:

folding a membrane having opposing longitudinal edges along a longitudinal axis to form a folded membrane, the folded membrane having a lower layer and an upper layer, wherein the longitudinal edges of the lower and upper layers are spaced from one another to provide an exposed portion of an upper planar surface of the lower layer; and applying a primer over the exposed portion of the lower layer and over a portion of the bottom planar surface of the upper layer adjacent to the exposed portion of the lower layer, thereby forming a pre-primed membrane having first and second primed areas, wherein the primed areas are on opposing planar surfaces of the membrane.

2. The method of claim 1, where the primer includes a solvent, and further comprising the step of allowing at least a portion of the solvent in the primer to evaporate to create a first primed area on the exposed portion of the lower layer and a second primed area on the edge portion of the upper layer.

3. The method of claim 2, further comprising the step of securing an adhesive tape on at least one of the first and second primed areas.

4. The method of claim 2, further comprising the step of securing a release liner over one of the first and second primed areas.

5. The method of claim 2, further comprising the step of securing a release liner over both the first and second primed areas.

6. The method of claim 1, wherein the exposed portion of the lower layer has a width of between 25 and 305 mm.

7. The method of claim 1, wherein the exposed portion of the lower layer has a width of between 76 and 203 mm.

8. The method of claim 2, wherein the second primed area on the upper layer has a width of between 3 and 12 inches.

9. The method of claim 2, wherein the second primed area on the upper layer has a width of between 4 and 8 inches.

10. The method of claim 1, wherein the step of applying a primer includes applying a primer having a solids content of less than 20%.

11. The method of claim 1, wherein the step of applying a primer includes applying a primer having a solids content of less than 10%.

12. The method of claim 1, wherein the step of applying a primer is performed using a scrubber pad.

13. A method of pre-priming a membrane comprising:

folding a first longitudinal edge of a membrane toward a center of the membrane along a first longitudinal axis;

folding a second longitudinal edge of the membrane toward the center of the membrane along a second longitudinal axis to create a folded membrane, wherein the first and second longitudinal edges are each spaced from a center of the membrane to provide an exposed portion of a lower layer of the folded membrane; and applying a primer over the exposed portion of the lower layer, a first edge portion adjacent the first longitudinal edge of the membrane and a second edge portion adjacent the second longitudinal edge of the membrane, where the first edge portion and the second edge protion are on a planar surface of the membrane opposite a planar surface of the exposed portion of the lower layer, thereby forming a pre-primed membrane having first, second, and third primed areas, wherein the first and second primed areas are on a first planar surface of the membrane, and the third primed area is on a second planar surface of the membrane that is opposite the first planar surface.

14. The method of claim 13, further comprising the step of allowing solvents in the primer to vaporize to create a first primed area on the first edge portion, a second primed area on the second edge portion and a center primed area on the exposed portion of the membrane.

15. The method of claim 13, further comprising the step of cutting along a longitudinally extending center line of the folded membrane between the first and second longitudinal edges to create two pre-primed membranes.

16. The method of claim 14, further comprising the steps of applying an adhesive tape on the center primed area, and cutting along the longitudinal center of the membrane to create two membranes each having a pre-primed edge and a pre-taped edge.

17. The method of claim 14, further comprising the step of securing a release liner over the first, second and center primed areas.

18. The method of claim 14, further comprising the step of securing a release liner over the first and second primed areas.

19. The method of claim 13, wherein the exposed portion of the lower layer of the folded membrane has a width of between 102 and 610 mm.

20. The method of claim 13, wherein the exposed portion of the lower layer of the folded membrane has a width of between 152 and 254 mm.

21. The method of claim 13, wherein the first and second edge portions each have a width of between 76 and 305 mm.

22. The method of claim 13, wherein the first and second edge portions each have a width of between 102 and 203 mm.

23. The method of claim 13, wherein the step of applying a primer includes applying a primer having a solids content of less than 20%.

24. The method of claim 13, wherein the step of applying a primer includes applying a primer having a solids content of less than 10%.

25. The method of claim 13, wherein the step of applying a prime is performed using a scrubber pad.

26. A method of pre-priming a membrane comprising:

folding a membrane having opposing longitudinal edges along a longitudinal axis to create a folded membrane, wherein the folded membrane includes a lower layer and an upper layer, and wherein a portion of the lower layer is uncovered by the upper layer; and applying a primer over at least a part of the uncovered portion of the lower layer and at least a part of the upper layer simultaneously.

* * * * *